US006433744B1

(12) United States Patent
Hershey et al.

(10) Patent No.: US 6,433,744 B1
(45) Date of Patent: Aug. 13, 2002

(54) WIDEBAND PATCH ANTENNA

(75) Inventors: John Erik Hershey, Ballston Spa; Gregory Bruce Robinson, Fultonville; Kenneth Brakeley Welles, II, Scotia, all of NY (US); Daniel White Sexton, Charlottesville, VA (US); David Michael Davenport, Niskayuna; Gary William Yeager, Schenectady, both of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/732,699

(22) Filed: Dec. 11, 2000

Related U.S. Application Data

(60) Provisional application No. 60/188,513, filed on Mar. 10, 2000.

(51) Int. Cl.[7] ..... H01Q 1/38

(52) U.S. Cl. ..... 343/700 MS; 343/853

(58) Field of Search ..... 343/700 MS, 850, 343/853; 333/204, 238, 246

(56) References Cited

U.S. PATENT DOCUMENTS

| | | | | |
|---|---|---|---|---|
| 4,201,989 A | | 5/1980 | Czerwinski | 343/715 |
| 4,847,625 A | | 7/1989 | Dietrich et al. | 343/700 MS |
| 5,594,455 A | * | 1/1997 | Hori et al. | 343/700 MS |
| 6,034,637 A | | 3/2000 | McCoy et al. | 343/700 MS |
| 6,097,271 A | * | 8/2000 | Kozakoff | 333/204 |
| 6,206,292 B1 | * | 3/2001 | Robertz et al. | 235/488 |

OTHER PUBLICATIONS

"Dieletric Spectroscopy of Polymeric Materials," James P. Runt; John J. Fitzgerald, American Chemical Society, p. 209.

"Conformal Microstrip Antennas and Microstrip Phased Arrays," Robert E. Munson, IEEE Transactions on Antennas and Propagation, Jan. 1974, pp. 74–78.

* cited by examiner

*Primary Examiner*—Don Wong
*Assistant Examiner*—Hoang Nguyen
(74) *Attorney, Agent, or Firm*—Jill M. Breedlove; Christian G. Cabou

(57) ABSTRACT

An antenna comprising two essentially identical electrically conducting rectangular plates lying in parallel planes and separated so that a gap is formed between the plates also includes a dielectric situated within the gap and exhibiting a relative permittivity that changes with frequency. Electrical connectors connect the plates to corresponding conductors that carry the signal to be radiated by the antenna.

7 Claims, 4 Drawing Sheets

WIDEBAND PATCH ANTENNA

CROSS REFERENCE TO RELATED APPLICATIONS

This invention is the nonprovisional application of provisional application Serial No. 60/188,513, filed Mar. 10, 2000.

BACKGROUND OF THE INVENTION

The invention relates to radio wave antennas and directive radio wave systems and devices, and more particularly to a compact electromagnetic antenna that can be used in conformity with a variety of surfaces and supports wideband signaling.

At present there is a broad class of antennas whose members support wideband signaling. For purposes of this application, the term "wideband" is intended to mean signals that have bandwidths several tens of percent of the center frequency of the communications. There are also narrowband antennas whose physical envelope characteristics require only very small volumes and areas, and can be conformally placed on surfaces of gradual contours. A class of such antennas is known in the art as patch antennas or microstrip antennas.

Patch antennas are a subset of resonant antennas and therefore are capable of signaling over only a small bandwidth, on the order of a few percent of center frequency. This behavior is discussed by Professors Stutzman and Thiele in the second edition of their text *Antenna Theory and Design*, John Wiley & Sons 1998. The main challenge in microstrip antenna design is thus to achieve a wider signaling bandwidth.

Currently, there are several communication systems in development that propose to employ very wideband signaling. Many of these desired systems will require, or would greatly benefit from, a small volume conformal antenna. There is therefore a recognized need for a patch antenna that is capable of handling wideband signaling.

BRIEF SUMMARY OF THE INVENTION

Briefly, in accordance with a preferred embodiment of the invention, two essentially identical electrically conducting rectangular plates are provided, with their surfaces separated and lying in parallel planes. A frequency dependent dielectric is situated between the plates and electrical conductors are connected to the plates, thus forming a patch antenna that is resonant over a wideband frequency range and is consequently capable of radiating and receiving a wideband signal.

DETAILED DESCRIPTION OF THE INVENTION

Figure 1:
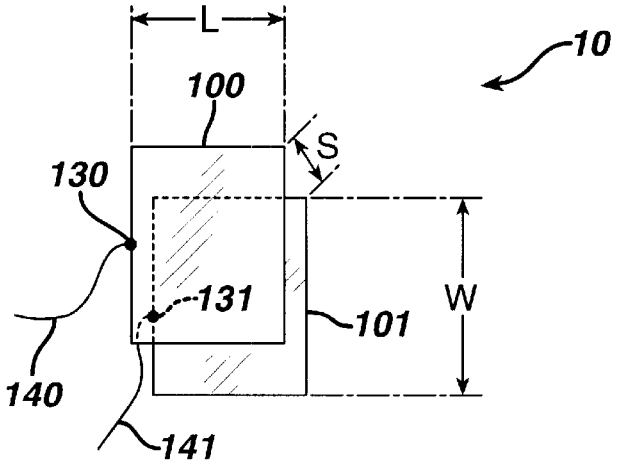
FIGS. 1 and 2 are two perspective views of the elements of the wideband patch antenna and their relative orientations according to two different constructions of a preferred embodiment of the invention.

In FIG. 1, the preferred embodiment of the antenna is shown constructed of two thin conductive plates 100 and 101. The plates are comprised of an electrically conductive material such as copper, and are essentially identical and rectangular in shape, having dimensions L (length) by W (width). The plates are rectangles formed by plates 100 and 101 are positioned such that they are congruent without rotation. The geometry governing the relative placement of the two conducting plates is such that if the four plate edges of plate 100 are joined, respectively, to the congruent edges of plate 101 by electrically nonconductive planar surface segments between the edges, the volume thus formed is a cuboid since it possesses eight rectangular solid angles and twelve edges that are equal and parallel in fours. The three pairs of congruent rectangles that lie in parallel planes bound the volume of the cuboid. FIG. 1 also shows a conductor 140 electrically connected to plate 100 via a connector 130 and a conductor 141 electrically connected to plate 101 via a connector 131. One of conductors 140 and 141 may be the inner conductor of a coaxial cable and the other of conductors 140 and 141 may be the outer conductor or sheath of the coaxial cable. Other useful conductor configurations will be obvious to those skilled in the art.

Figure 2:
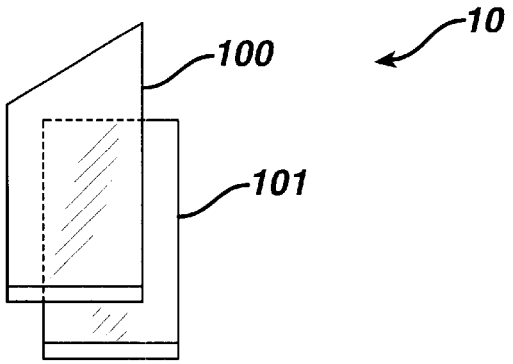

In the preferred embodiment of the antenna, depicted in FIG. 2, one edge of plate 100 is substantially non-parallel to the corresponding edge of plate 101.

Figure 3:
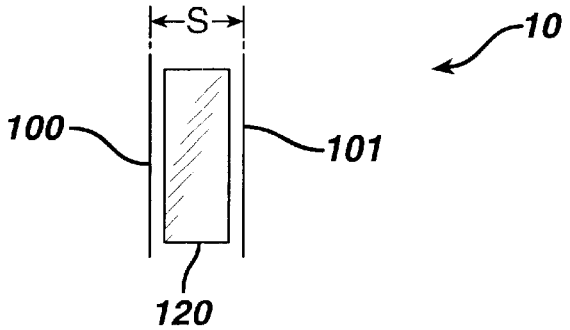
FIG. 3 is a cross-sectional view of the elements of the wideband patch antenna of FIG. 1 or 2, showing a dielectric situated between the plates.

FIG. 3 shows wideband patch antenna 10 in cross-section. In this view, the gap formed by the separation of plates 100 and 101 contains a dielectric 120 whose permittivity is a function of frequency.

Figure 4:
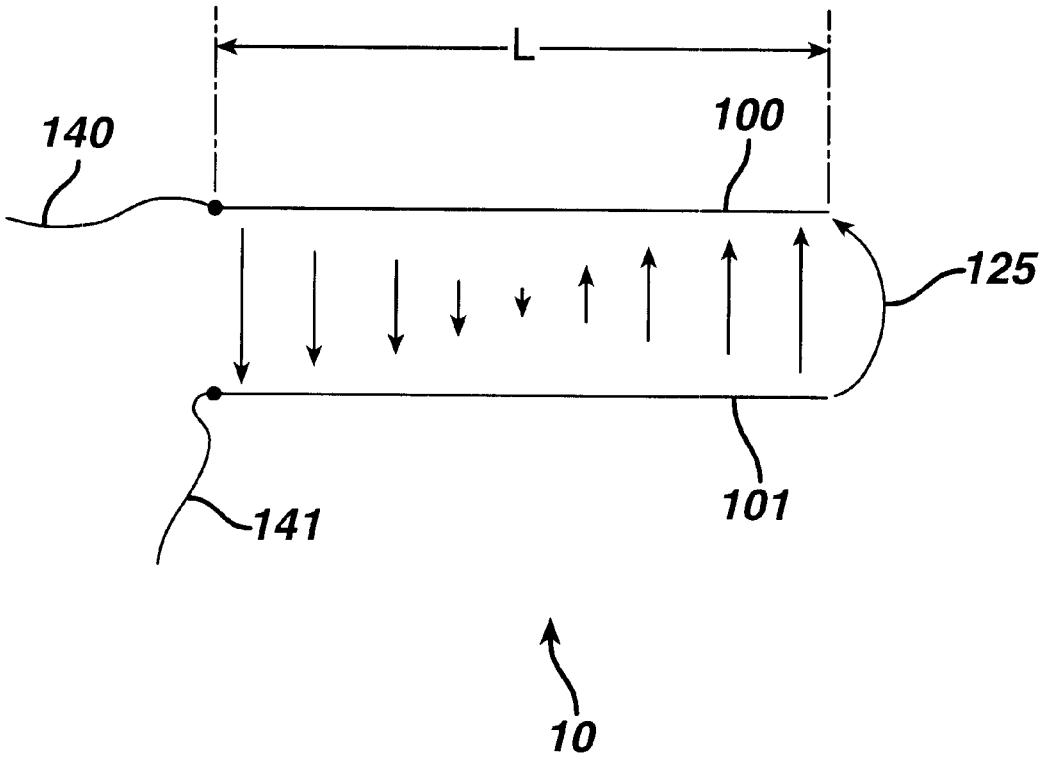
FIG. 4 is an illustration of an instantaneous electric field within, and extending just beyond, the physical boundary of the patch antenna.

FIG. 4 is an illustration of an electric field 125, instantaneously, within, and at the edge of, the patch antenna, and depicts the electric field from the edge at which the connectors are attached, extending to the opposite edge (and beyond), in a resonance condition that is the condition sought to be achieved over a wide bandwidth. Wideband patch antenna 10 of FIGS. 1–3 will impart different group delays to the different spectral components of the signal to be radiated, as resonance is determined not by the physical length of propagation but rather by the electrical length of propagation. The electrical length is approximately $L/\sqrt{\epsilon_r}$ where $\epsilon_r$ is the relative permittivity of dielectric 120. The relative permittivity of the dielectric is the permittivity of the dielectric divided by the permittivity of free space. Thus, the length L of plates 100 and 101 is chosen according to the formula $L \approx 0.5 \cdot \sqrt{\epsilon_r} \lambda_c$ where $\lambda_c$ is the center wavelength of the ultra-wideband signal to be accommodated by the wideband patch antenna. The width W of the wideband patch antenna is chosen according to the formula $$W \approx \frac{9.49 L \epsilon_r}{\sqrt{Z_A(\epsilon_r - 1)}}$$

where $Z_A$ is the desired antenna impedance in ohms at the center wavelength. The spacing dimension S is chosen to satisfy the condition $S \ll \lambda_c$. Thus, for example, if the wideband signal were to have a center frequency of 7.5 GHz and a dielectric exhibiting a relative permittivity of 4 at 7.5 GHz, then $L \approx 1$ cm. If there were need for the wideband patch antenna to present a 50 ohm impedance at center frequency with the example parameters, the antenna width would be chosen such that W≈3.1 cm. The constraint on the spacing dimension S could be satisfied by choosing S≈4 mm.

By selecting a relative permittivity for dielectric 120 that varies approximately as the inverse square of the frequency, an antenna is realized that exhibits resonance or near resonance over a significantly wider bandwidth than that of a similar antenna employing a dielectric whose relative permittivity does not vary appreciably with frequency. An example of a dielectric meeting this condition over the frequency range of 5–10 GHz is an aqueous solution of poly(vinyl pyrrolidone) (PVP) which is 60% PVP by weight. The dielectric characterization of this solution of PVP is reported on p. 209 of *Dielectric Spectroscopy of Polymeric Materials* by James P. Runt and John J. Fitzgerald, American Chemical Society. The aqueous solution may be further processed into a gel by adding a gelling agent.

Figure 5:
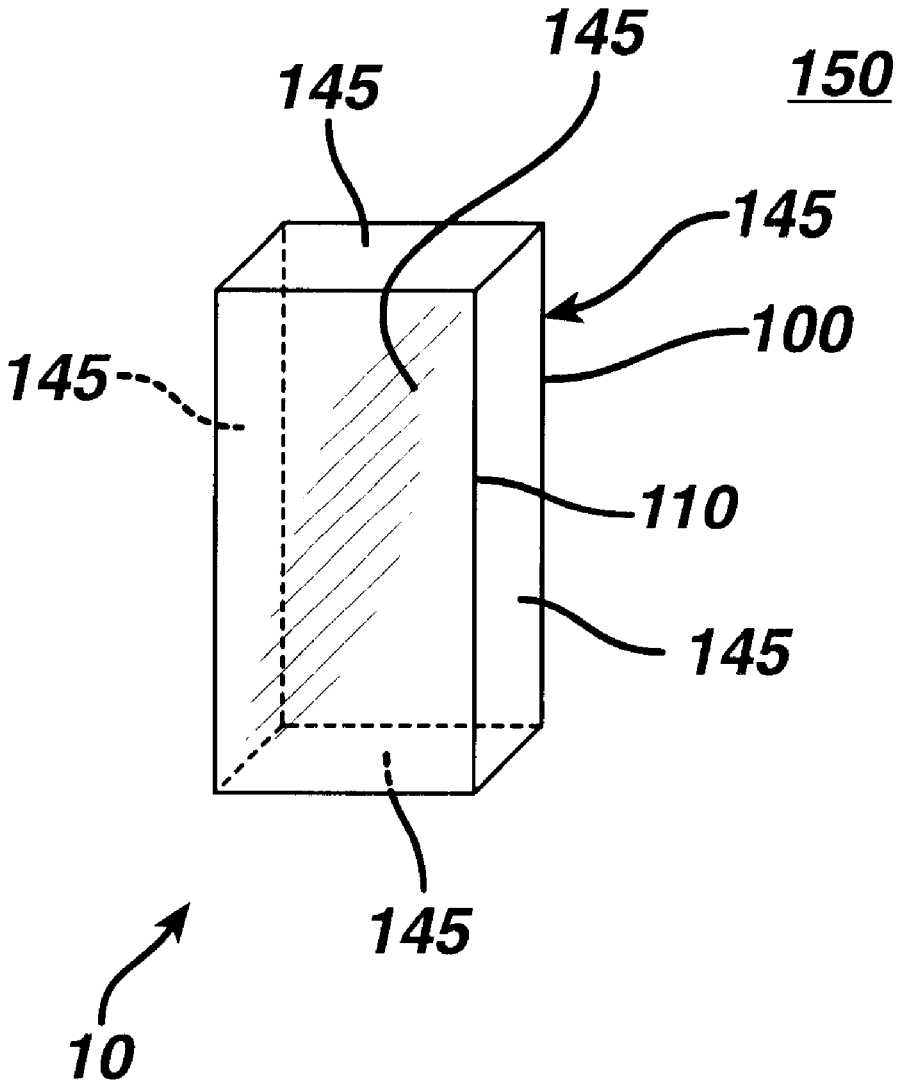
FIG. 5 is a perspective view of an encasement structure for containing a non-solid dielectric between the two electrically conducting plates of the patch antenna.

FIG. 5 is a perspective view of a container 150 for a liquid dielectric (or a gel dielectric, if desired) to be situated within the gap formed by the separation of plates 100 and 101. Container 150 may comprise a thin, non-electrically conductive membrane or a set of four non-electrically conductive plates or walls 145 forming a cuboid when joined with conducting plates 100 and 101. The container may be fabricated of an electrically nonconductive material such as polystyrene and not appreciably contribute to the capacitance of the antenna, which will be true if the polystyrene wall thickness is very small with respect to the physical length L of the conducting plates.

Figure 6:
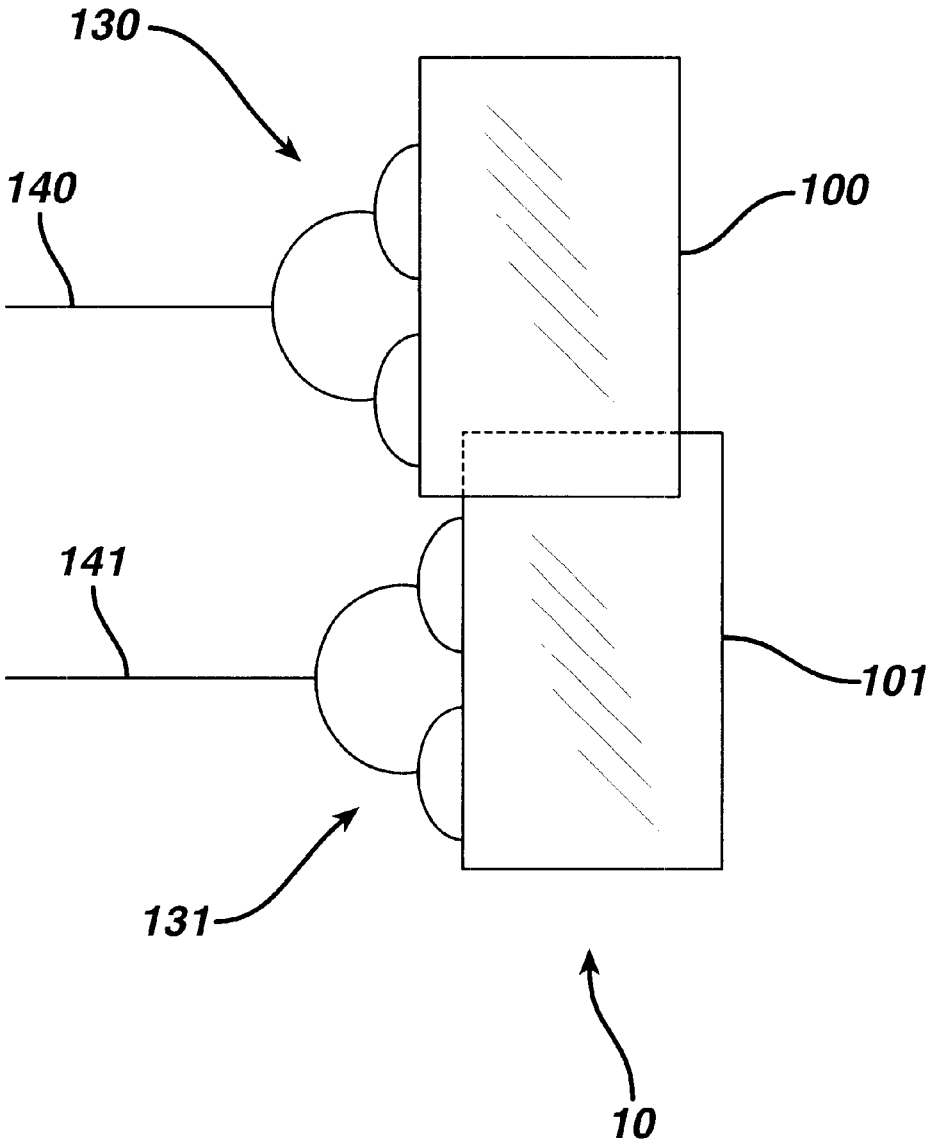
FIG. 6 is a perspective view of an alternative wideband feed for coupling the signal to be transmitted to the wideband patch antenna.

FIG. 6 is a perspective view of electrically conductive plates 100 and 101 with electrical connector 130 connecting electrically conductive plate 100 to conductor 140 and electrical connector 131 connecting electrically conductive plate 101 to conductor 141. Connectors 130 and 131 are power-of-2 feed networks and appropriate baluns, and each connector comprises a feed network similar to one described in "*Conformal Microstrip Antennas and Microstrip Phased Arrays*" by Robert E. Munson, IEEE Transactions on Antennas and Propagation, January 1974, pp. 74–78. In this feed network, the number of power divisions is a power of 2 and the geometry is such that each connection of the feed network is at an equal distance, respectively, from each conductor to its respective conductive antenna plate. This ensures that each of the conductive antenna plates is presented with the same electrical phase across its width. FIG. 6 shows $2^2=4$ power divisions as a non-limiting example. An identical power-of-2 feed network is attached to each of electrically conductive antenna plates 100 and 101.

It will be appreciated that wideband patch antenna 10 may be used to receive a wideband signal and also to transmit a wideband signal. It will also be appreciated that the dielectric employed in wideband patch antenna 10 may be designed so that the spectral components of a received or radiated signal are delayed unequally in time, due to their unequal propagation times through the dielectric, in order to provide for signal shaping and pulse compression.

While only certain preferred features of the invention have been illustrated and described, many modifications and changes will occur to those skilled in the art. It is, therefore, to be understood that the appended claims are intended to cover all such modifications and changes as fall within the true spirit of the invention.

What is claimed is:

1. A wideband patch antenna comprising:

first and second essentially identical electrically conducting rectangular plates, said plates being separated and lying in parallel planes so that a gap is formed between the plates;

a dielectric situated within said gap, said dielectric exhibiting a relative permittivity that changes with frequency in a predetermined manner; and connectors for electrically connecting said plates to corresponding conductors, each of said connectors comprising a power-of-2 feed network.

2. The antenna according to claim 1 wherein said dielectric comprises polyvinyl pyrrolidone.

3. The antenna according to claim 1 wherein said dielectric comprises an aqueous solution of polyvinyl pyrrolidone of up to 60% polyvinyl pyrrolidone by weight.

4. The antenna according to claim 3 wherein said dielectric further comprises a gelling agent.

5. The antenna according to claim 4 wherein said dielectric is confined within an electrically nonconductive container.

6. The antenna according to claim 3 wherein said dielectric is confined within an electrically nonconductive container.

7. The antenna according to claim 1 wherein the relative permittivity of the dielectric $\epsilon_r$ is dependent upon the length L of said plates and the center wavelength $\lambda_c$ according to the formula $L \approx 0.5 \cdot \sqrt{\epsilon_r}\lambda_c$.

* * * * *